US008783765B1

(12) United States Patent
Matus et al.

(10) Patent No.: US 8,783,765 B1
(45) Date of Patent: Jul. 22, 2014

(54) SELF-SUPPORTING POOLSIDE CHILD SEAT

(76) Inventors: Karen Matus, Ford City, PA (US); Ali Matus, Ford City, PA (US)

( * ) Notice: Subject to any disclaimer, the term of this patent is extended or adjusted under 35 U.S.C. 154(b) by 267 days.

(21) Appl. No.: 13/424,405

(22) Filed: Mar. 20, 2012

(51) Int. Cl.
*A47B 39/00* (2006.01)

(52) U.S. Cl.
USPC ..... 297/152; 297/153; 297/147; 4/578.1; 4/579; 4/496

(58) Field of Classification Search
USPC ..... 297/152, 147, 153; 4/578.1, 579, 496
See application file for complete search history.

(56) References Cited

U.S. PATENT DOCUMENTS 1,217,950 A * 3/1917 Johnston ..... 297/149
1,283,225 A * 10/1918 Lea ..... 297/149
2,371,903 A * 3/1945 Maier ..... 248/231.85
2,867,401 A * 1/1959 Sheahan ..... 248/231.41
3,664,626 A * 5/1972 Sneller ..... 248/224.7
3,793,516 A * 2/1974 Cassey ..... 362/257
4,248,255 A * 2/1981 Arrowsmith ..... 135/96
4,312,536 A * 1/1982 Lloyd ..... 4/559
4,369,109 A * 1/1983 Edge ..... 210/167.19
4,763,895 A * 8/1988 Tepper ..... 472/101
4,837,869 A * 6/1989 Simmon ..... 4/496
4,893,363 A * 1/1990 Huff ..... 4/496
5,307,527 A * 5/1994 Schober ..... 4/496
5,333,322 A * 8/1994 Weir ..... 4/496
5,607,527 A * 3/1997 Isley, Jr. ..... 156/71
5,857,226 A * 1/1999 Sommer ..... 4/496
5,860,171 A * 1/1999 Hicks ..... 4/496
D406,474 S * 3/1999 Toledo et al. ..... D6/362
6,311,343 B1 * 11/2001 Wisniewski ..... 4/496
6,474,244 B1 * 11/2002 Karpinski ..... 108/42
6,595,861 B1 * 7/2003 Morrow et al. ..... 472/134
6,637,045 B1 * 10/2003 Larsen ..... 4/496
7,008,281 B2 * 3/2006 Ketko ..... 441/130
7,077,537 B2 * 7/2006 Hui ..... 362/101
D533,445 S * 12/2006 Janzen ..... D8/380
D534,368 S * 1/2007 Karpinski ..... D6/396
7,549,706 B2 * 6/2009 Scheurer et al. ..... 297/452.18
7,571,965 B1 * 8/2009 Perry ..... 297/452.26
7,810,180 B2 * 10/2010 List ..... 4/572.1
7,992,833 B1 * 8/2011 Goodman et al. ..... 248/298.1
8,025,172 B1 * 9/2011 Zink ..... 220/485
8,459,736 B1 * 6/2013 Begley, Jr. ..... 297/217.7
2001/0035202 A1 * 11/2001 Moskowitz et al. ..... 135/16
2008/0092285 A1 * 4/2008 Petersen ..... 4/496
2009/0100587 A1 * 4/2009 Smith ..... 4/496
2011/0099708 A1 * 5/2011 Freedman ..... 4/496
2012/0175919 A1 * 7/2012 Kane ..... 297/158.3

* cited by examiner

*Primary Examiner* — Laurie Cranmer
(74) *Attorney, Agent, or Firm* — Kyle A. Fletcher, Esq.

(57) ABSTRACT

The self-supporting poolside child seat places a partially submerged child seat in a pool, and secures said child seat against a side of an above-ground swimming pool. The self-supporting poolside child seat includes straps that secure the child to the child seat as a safety precaution when in use in the water of said pool. A canopy extends from behind said child seat to provide shade to the child seated therein. Armrests extend from the child seat, and provide a means by which a tray may attach to the child seat for use as a surface to place food or toys thereon. Adjustable supports extend to the rear of the child seat and work in concert with diagonal supports to secure the child seat to the side of the above-ground swimming pool.

14 Claims, 5 Drawing Sheets

SELF-SUPPORTING POOLSIDE CHILD SEAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of child seats, more specifically, a child seat that attaches onto a side of an above-ground swimming pool.

There are a multitude of chair and seats that are partially submerged in a pool, and which enable an occupant to be seated in said pool. However, the chair and seats are not adaptive for use with a side of an above-ground swimming pool. Moreover, the chair and seats are not capable of acting as a child seat that secures a child thereon, and which prevents said child from falling into the water.

What is needed is a child seat that attaches onto a side of an above-ground swimming pool, and which secures a child thereon, and which is partially submerged into the water of said pool. What is also needed is an extendable canopy or umbrella seat. The device of the present application seeks to improve upon the prior art, and addresses the needs for a child seat for use with an above-ground swimming pool.

B. Discussion of the Prior Art

As will be discussed immediately below, no prior art discloses a self-supporting poolside child seat that has the child seat partially submerged within said pool; wherein said child seat restrains and prevents said child from falling beneath the water level; wherein the child seat is adapted for use alongside of a side of an above-ground swimming pool, and includes adjustable supports that accommodate different pool side thicknesses, and works in conjunction with diagonal supports having suction cups thereon, which attach onto the inner surface of said side of said pool; wherein a canopy extends from behind said child seat and provides shade to a child seated therein; armrests extend on opposing sides of the child seat and enable a tray to attach thereon to provide a surface with which to place food or objects for use by a child seated therein.

The Larsen Patent (U.S. Pat. No. 6,637,045) discloses a portable poolside chair permitting a user to sit partially submerged comprising a pool deck portion supported by the pool deck and a backrest, which contacts the pool wall. However, the partially submerged poolside chair is not a child seat that restrains a child onto said seat while providing a canopy above said child or a tray in front of said child.

The Tepper Patent (U.S. Pat. No. 4,763,895) discloses child's playseat with suction cups for attachment to a tub or pool. However, the playseat attaches to a bottom surface of a tub or pool, and is not supported along a side of an above-ground pool.

The Smith Patent Application Publication (U.S. Pub. No. 2009/0100587) discloses a swimming pool seat comprising an upper wall support member for affixing to the seat support member to a pool deck. However, the swimming pool seat is not a child seat that secures a child into said seat along a side of an above-ground swimming pool, and which includes a canopy and tray.

The Wisniewski Patent (U.S. Pat. No. 6,311,343) discloses a swimming pool lounge chair having a pool perimeter mounting portion. However, the swimming pool lounge chair has a mounting portion that rests on the floor of the pool, and is not a child seat that supports itself along a side of an above-ground swimming pool.

The Morrow et al. Patent (U.S. Pat. No. 6,595,861) discloses an inflatable children's pool with a centrally located safety seat and a detachable shade. However, the seat is not able to attach along a side of an above-ground swimming pool.

The Schober patent (U.S. Pat. No. 5,307,527) discloses a pool chair adapted to be partially submerged having an upper cross member adapted to rest along the perimeter of the pool. However, the partially submgered pool chair is not a child seat that attaches onto a side of an above-ground swimming pool, nor does the pool chair include a canopy or tray.

While the above-described devices fulfill their respective and particular objects and requirements, they do not describe a self-supporting poolside child seat that has the child seat partially submerged within said pool; wherein said child seat restrains and prevents said child from falling beneath the water level; wherein the child seat is adapted for use alongside of a side of an above-ground swimming pool, and includes adjustable supports that accommodate different pool side thicknesses, and works in conjunction with diagonal supports having suction cups thereon, which attach onto the inner surface of said side of said pool; wherein a canopy extends from behind staid child seat and provides shade to a child seated therein; armrests extend on opposing sides of the child seat and enable a tray to attach thereon to provide a surface with which to place food or objects for use by a child seated therein. In this regard, the self-supporting poolside child seat departs from the conventional concepts and designs of the prior art.

SUMMARY OF THE INVENTION

The self-supporting poolside child seat places a partially submerged child seat in a pool, and secures said child seat against a side of an above-ground swimming pool. The self-supporting poolside child seat includes straps that secure the child to the child seat as a safety precaution when in use in the water of said pool. A canopy extends from behind said child seat to provide shade to the child seated therein. Armrests extend from the child seat, and provide a means by which a tray may attach to the child seat for use as a surface to place food or toys thereon. Adjustable supports extend to the rear of the child seat and work in concert with diagonal supports to secure the child seat to the side of the above-ground swimming pool. The diagonal supports include suction cups that adhere to the inner surface of the swimming pool whereas the adjustable supports extend over top of the side of the swimming pool.

An object of the invention is to provide a child seat that is partially submerged into a swimming pool, and which includes strap to secure said child therein.

Another object of the invention is to provide a child seat that includes means of supporting itself onto the side of the swimming pool.

An even further object of the invention is to provide a pair of adjustable supports that extend to the rear of the child seat, and which attach over top of the side of the swimming pool.

An even further object of the invention is to provide means of adjustment of the adjustable supports with pool sides having different thicknesses.

An even further object of the invention is to provide a pair of diagonal supports that extend from under said child seat and include suction cups for adherence with the inner side surface of the swimming pool.

An even further object of the invention is to provide a pivoting means onto the diagonal supports such that the angle formed with respect to the side of the swimming pool is adjustable.

Another object of the invention is to provide a canopy that extends from behind said child seat, and which provides shade to a child seated therein.

Another object of the invention is to include a pair of armrests that extend on opposing sides of the child seat, and which enable a tray to attach thereon in order to provide a surface with which to support food or toys or other items thereon when in use.

These together with additional objects, features and advantages of the self-supporting poolside child seat will be readily apparent to those of ordinary skill in the art upon reading the following detailed description of presently preferred, but nonetheless illustrative, embodiments of the self-supporting poolside child seat when taken in conjunction with the accompanying drawings.

In this respect, before explaining the current embodiments of the self-supporting poolside child seat in detail, it is to be understood that the self-supporting poolside child seat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the self-supporting poolside child seat.

It is therefore important that the claims be regarded as including such equivalent construction insofar as they do not depart from the spirit and scope of the self-supporting poolside child seat. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
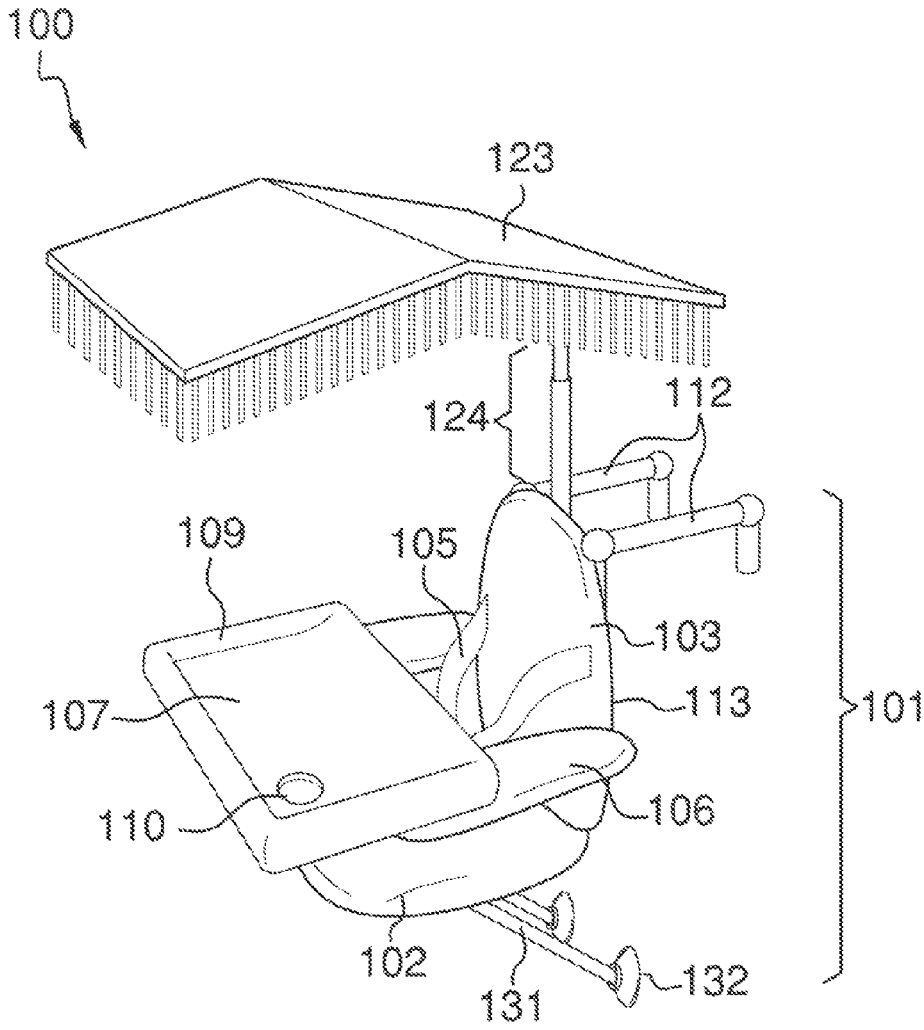
FIG. 1 illustrates a perspective view of the self-supporting poolside child seat by itself.
Figure 2:
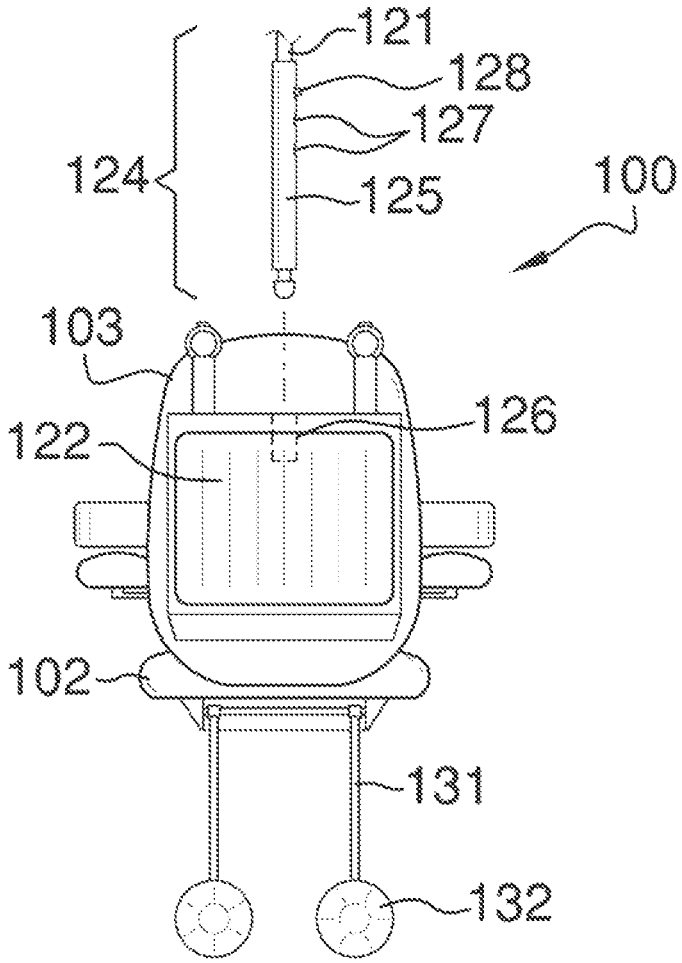
FIG. 2 illustrates a rear view of the child seat with a detail as to the extendable canopy aligned above the child seat.
Figure 3:
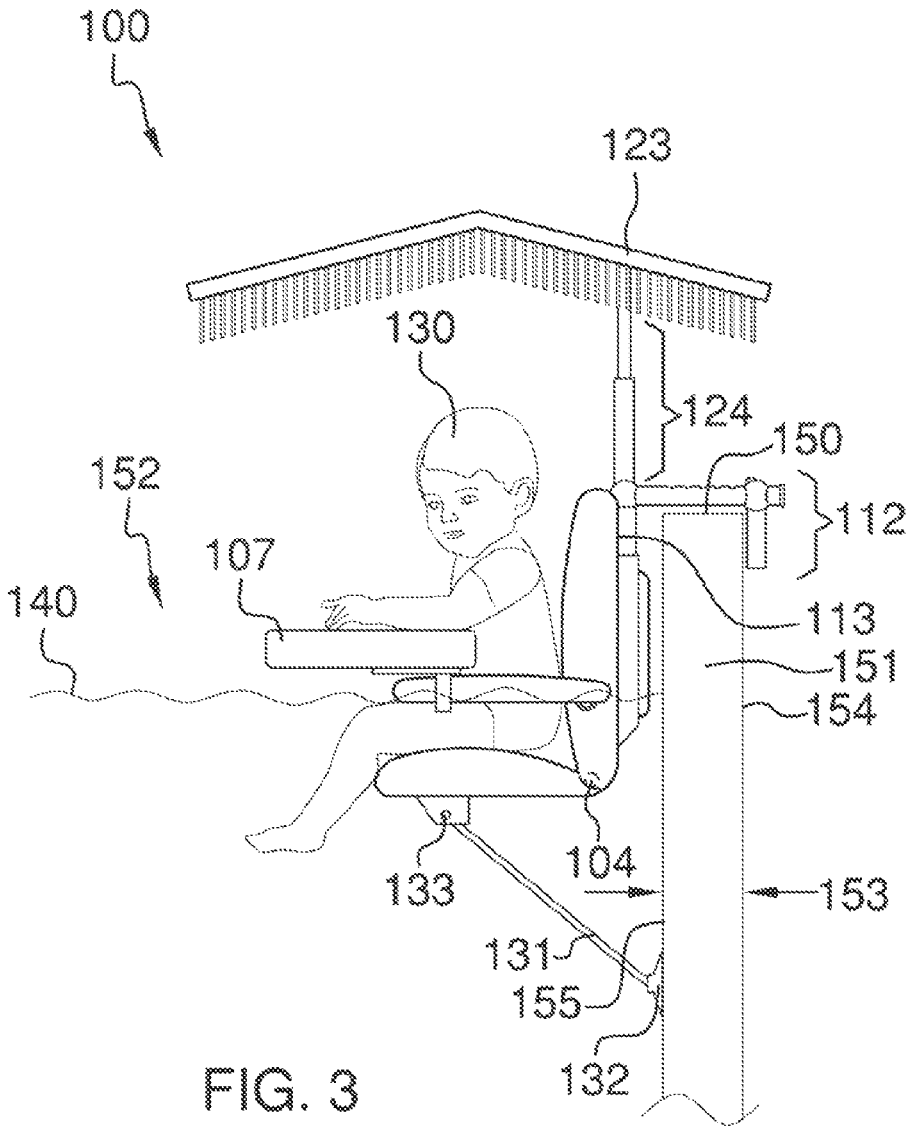
FIG. 3 illustrates a side view self-supporting poolside child seat installed upon a side of an above-ground swimming pool.
Figure 4:
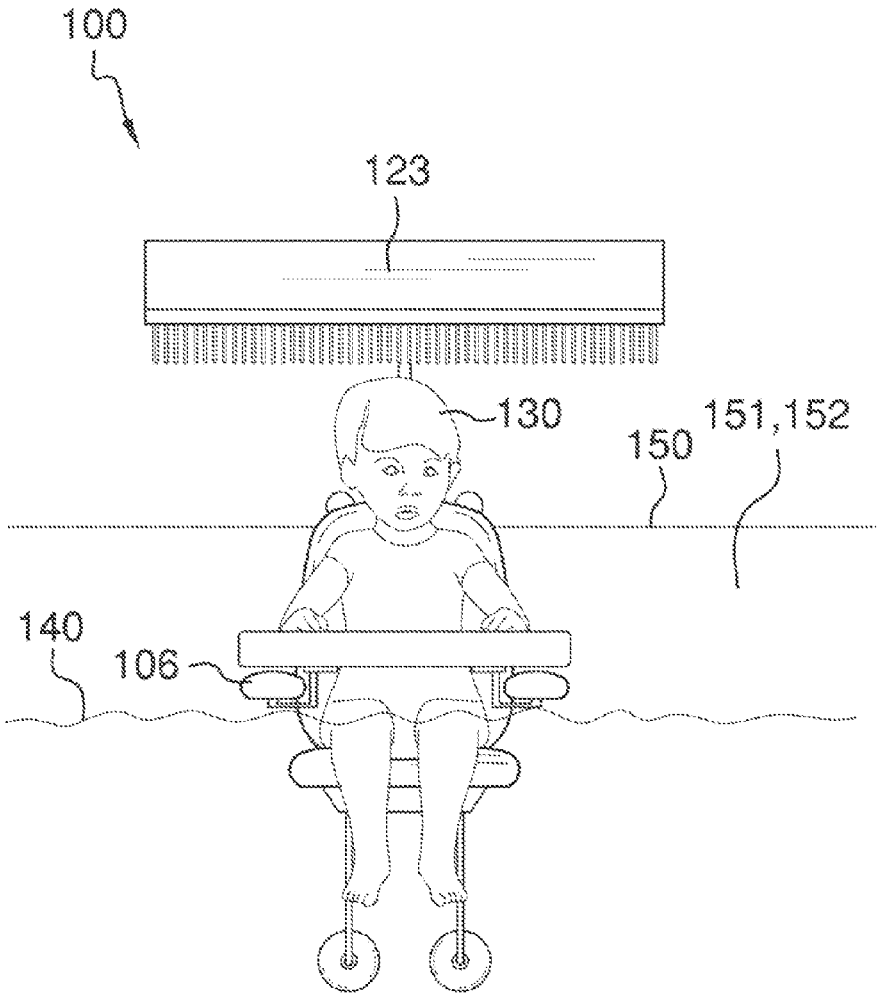
FIG. 4 illustrates a front view of the self-supporting poolside child seat in which a child is seated therein, and affixed onto the side of the above-ground swimming pool.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A self-supporting poolside child seat 100 (hereinafter invention) includes a child seat 101 comprised of a seat 102 and a seat back 103 that connect at a pivot point 104 such that the seat 102 can rotate from a horizontal position (see FIG. 3) to a folded up position (see FIG. 5).

The child seat 101 includes straps 105, which are used to secure a child 130 onto the child seat 101. The child seat 101 also includes a pair of arm rests 106 that extend from opposing sides of the seat back 103, and which provide support to the child 130 placed therein. The arm rests 106 are capable of supporting a tray 107 onto the invention 100. The tray 107 has a couple of brackets 108 that slide onto the arm rests 106 such that the tray 107 provides a surface upon which to place items such as food, toys, etc. The tray 107 also includes a lip 109 along the perimeter, which prevents water 140 from splashing onto the tray 107. That being said, the tray 107 may also include a drain hole 110 that enables water 140 to drain from the tray 107 as needed. It shall be noted that the drain hole 110 may also be in the form of a cup holder.

Figure 5:
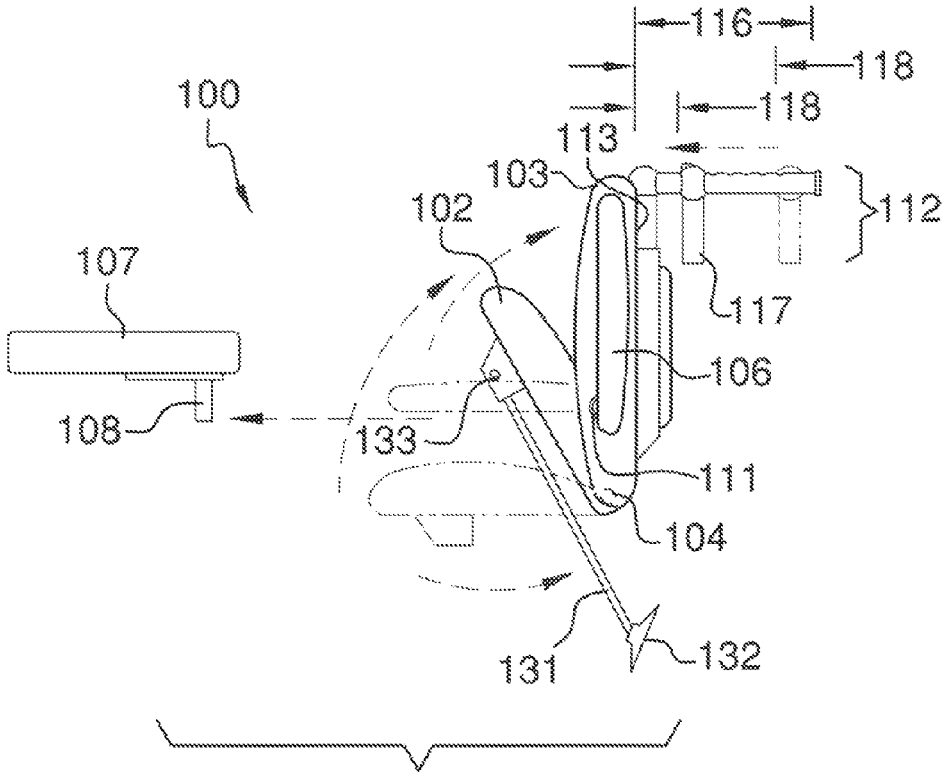
FIG. 5 illustrates a side view of the extension of the extendable, supports as well as rotation of the seat portion of the child seat as well as removal of the tray from the armrests.
Figure 6:
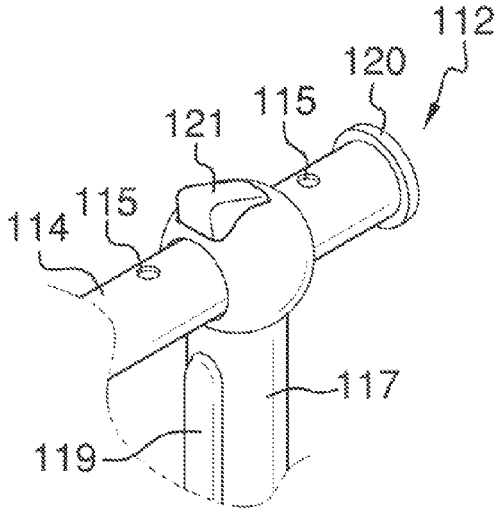
FIG. 6 illustrates a detail of one of the extendable supports detailing the release button that enables adjustment of the adjustable support.

It shall be noted that the arm rests 106 attach to the seat back 103 via an arm rest pivot point 111, which enables the arm rests 106 to fold from a horizontal position (see FIG. 3) to an upright position (see FIG. 5).

The invention 100 also includes adjustable supports 112 that extend from a rear surface 113 of the seat back 103. The adjustable supports 112 enable the invention 100 to hook onto a top edge 150 of a side 151 of an above-ground swimming pool 152. Moreover, the adjustable supports 112 enable partial submergence of the child seat 101 in the water 140 provided in the swimming pool 152. In referring to FIG. 3, the water 140 in the swimming pool 152 comes up to just underneath, the arm rests 106. That being said, the water 140 may cover the legs of the child 130 when installed and seated therein. However, shall be noted that the water level in the swimming pool 152 may vary, and thus place the water level above or below the arm rests 196.

The adjustable supports 112 are unique to the invention 100, in that the adjustable supports 112 are each constructed of a horizontal member 114 that extends from the rear surface 113 of the seat back 103. The horizontal members 114 each include a plurality of holes 115 along a length 116 of the respective horizontal member 114. A vertical member 117 attaches to the horizontal member 114, and extends downwardly to enable the adjustable support 113 to attach onto the top edge 150 of the side 151. The vertical member 117 is capable of moving along the length 116 of the horizontal member 114 in order to form a width 118, which is greater than or equal to a side thickness 153 of the side 151 of the swimming pool 152. The ability of the vertical member 117 to adjust the width 118 enables the invention 100 to attach onto swimming pools 152 having different sized or shaped sides 151.

The vertical member 117 includes a pad 119 along an inner surface, which engages against an outer surface 154 of the side 151 of the swimming pool 152. The horizontal member 114 may include a stopper 120, which prevents unintended separation of the vertical member 117 with respect to the horizontal member 114. The vertical member 117 also includes a spring-loaded button 121, which interacts with an aligned hole 115 to lock the vertical member 117 at a particular width 118 with respect to the horizontal member 114.

The invention 100 includes a seat back padding member 122 that is affixed onto the rear surface 113 of the seat back 103. The seat back padding member 122 is designed to rest against an inner surface 155 of the side 151 of the swimming pool 152. Moreover, the pad 119 of the vertical member 117 and the seat back padding member 122 of the seat back 103 engage both surfaces of the side 151, and prevent scratching to the swimming pool 152. It shall be noted that the seat back padding member 122 and the pad 119 are both made of a material suitable for use in and around the swimming pool 152, and may be made of a plastic with a soft foam therein, or simply a flexible plastic that is ideal for use and for preventing damage to the swimming pool 152.

The invention 100 includes a canopy 123 that attaches to the rear surface 113 of the seat back 103. Moreover, the canopy 123 extends over top of the child seat 101 to provide shade to the child 130 seated therein. The canopy 123 is further defined by a telescoping pole 124 comprised of a first pole 125 that attaches to a receptacle 126 integrated into the rear surface 113 of the seat back 103. The first pole 125 includes a plurality of holes 127 within which a spring-loaded button 128 engages. The spring-loaded button 128 is a part of a second pole 129. The second pole 129 telescopes with respect to the first pole 125 in order to adjust a height of the canopy 123 over top of the child seat 101.

The invention 100 also includes a pair of diagonal supports 131 that extend from underneath the seat 102. The diagonal supports 131 each include a suction cup 132, which adheres to the inner surface 155 of the side 151 of the swimming pool 152. The diagonal supports 131 each attach to a pivot point 133, and can rotate with respect to the seat 102 (see FIG. 5).

As a side note, the construction of the invention 100 shall be made of materials suitable for use in pool water, which is chlorinated. That being said, the various components of the child seat 101, the arm rests 106, the tray 107, the brackets 108 of the tray 107, the diagonal supports 131, the extendable supports 112, and the canopy 123 shall be made of plastics, carbon fiber composites, metals that resist oxidation.

Additionally, it shall be noted that the canopy 123 that provides shade shall be made of a weather resistant fabric that is durable for prolonged exposure to sunlight and outdoor elements.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A self-supporting poolside child seat comprising:

a child seat having extendable supports and diagonal supports for attachment onto a side of an above-ground swimming pool;

wherein the child seat is partially submerged into water of said swimming pool;

wherein the child seat is comprised of a seat and a seat back that connect at a pivot point such that the seat can rotate from a horizontal position to a folded up position;

wherein said extendable supports extend from a rear surface of the seat back, and are configured to hook onto a top edge of said side of said swimming pool; wherein the extendable supports are each constructed of a horizontal member that extends from the rear surface of the seat back, and a vertical member attached to and extending downwardly from the horizontal member;

wherein the horizontal members each include a plurality of holes along a length of the respective horizontal member; wherein the vertical member is capable of moving along the length of the horizontal member in order to form a width, which is greater than or equal to a side thickness of the side of the swimming pool;

wherein the horizontal member includes a stopper, which prevents unintended separation of the vertical member with respect to the horizontal member; wherein the vertical member includes a spring-loaded button, which interacts with an aligned hole to lock the vertical member at a particular width with respect to the horizontal member.

2. The self-supporting poolside child seat as described in claim 1 wherein said child seat is configured to support a child therein; wherein the child seat also includes a pair of arm rests that extend from opposing sides of the seat back.

3. The self-supporting poolside child seat as described in claim 2 wherein the arm rests enable a tray to attach thereon via brackets; wherein the tray includes a lip along the perimeter, which prevents water from splashing onto the tray.

4. The self-supporting poolside child seat as described in claim 2 wherein the arm rests attach to the seat back via an arm rest pivot point, which enables the arm rests to fold from a horizontal position to an upright position.

5. The self-supporting poolside child seat as described in claim 1 wherein the vertical member includes a pad along an inner surface, which engages against an outer surface of the side of the swimming pool.

6. The self-supporting poolside child seat as described in claim 1 wherein a seat back padding member is affixed onto the rear surface of the seat back.

7. The self-supporting poolside child seat as described in claim 1 wherein a canopy that attaches to the rear surface of the seat back, and extends over top of the child seat to provide shade to the child seated therein.

8. The self-supporting poolside child seat as described in claim 7 wherein the canopy is composed of a telescoping pole comprised of a first pole that attaches to a receptacle integrated into the rear surface of the seat back; wherein the first pole includes a plurality of holes within which a spring-loaded button engages; wherein the spring-loaded button is a part of a second pole, which telescopes with respect to the first pole in order to adjust a height of the canopy over top of the child seat.

9. The self-supporting poolside child seat as described in claim 1 wherein the diagonal supports extend from underneath the seat; wherein the diagonal supports each include a suction cup, which adheres to an inner surface of the side of the swimming pool; wherein the diagonal supports each attach to a pivot point, and can rotate with respect to the seat.

10. A self-supporting poolside child seat comprising:

a child seat having extendable supports and diagonal supports for attachment onto a side of an above-ground swimming pool;

wherein the child seat is partially submerged into water of said swimming pool;

wherein the child seat is comprised of a seat and a seat back that connect at a pivot point such that the seat can rotate from a horizontal position to a folded up position;

wherein said child seat is configured to support a child therein; wherein the child seat also includes a pair of arm rests that extend from opposing sides of the seat back;

wherein said extendable supports extend from a rear surface of the seat back, and are configured to hook onto a top edge of said side of said swimming pool; wherein the extendable supports are each constructed of a horizontal member that extends from the rear surface of the seat back, and a vertical member attached to and extending downwardly from the horizontal member;

wherein a canopy that attaches to the rear surface of the seat back, and extends over top of the child seat provides shade to the child seated therein;

wherein the horizontal members each include a plurality of holes along a length of the respective horizontal member; wherein the vertical member is capable of moving along the length of the horizontal member in order to form a width, which is greater than or equal to a side thickness of the side of the swimming pool;

wherein the horizontal member includes a stopper, which prevents unintended separation of the vertical member with respect to the horizontal member; wherein the vertical member includes a spring-loaded button, which interacts with an aligned hole to lock the vertical member at a particular width with respect to the horizontal member; wherein a seat back padding member is affixed onto the rear surface of the seat back.

11. The self-supporting poolside child seat as described in claim 10 wherein the arm rests enable a tray to attach thereon via brackets; wherein the tray includes a lip along the perimeter, which prevents water from splashing onto the tray; wherein the arm rests attach to the seat back via an arm rest pivot point, which enables the arm rests to fold from a horizontal position to an upright position.

12. The self-supporting poolside child seat as described in claim 10 wherein the vertical member includes a pad along an inner surface, which engages against an outer surface of the side of the swimming pool.

13. The self-supporting poolside child seat as described in claim 10 wherein the canopy is composed of a telescoping pole comprised of a first pole that attaches to a receptacle integrated into the rear surface of the seat back; wherein the first pole includes a plurality of holes within which a spring-loaded button engages; wherein the spring-loaded button is a part of a second pole, which telescopes with respect to the first pole in order to adjust a height of the canopy over top of the child seat.

14. The self-supporting poolside child seat as described in claim 10 wherein the diagonal supports extend from underneath the seat; wherein the diagonal supports each include a suction cup, which adheres to an inner surface of the side of the swimming pool; wherein the diagonal supports each attach to a pivot point, and can rotate with respect to the seat.

* * * * *